US005884811A

United States Patent [19]

Bunchman

[11] Patent Number: 5,884,811

[45] Date of Patent: Mar. 23, 1999

[54] COLLAPSIBLE DISPENSING TUBE WITH INTERLOCKING INTERNAL MEMBERS

[76] Inventor: Mark R. Bunchman, 112 Pine St., Breckenridge, Colo. 80424

[21] Appl. No.: 870,579

[22] Filed: May 21, 1997

[51] Int. Cl.[6] ..... B65D 35/08

[52] U.S. Cl. ..... 222/92; 222/107

[58] Field of Search ..... 222/92, 107

[56] References Cited

U.S. PATENT DOCUMENTS

| | | | |
|---|---|---|---|
| 1,286,875 | 12/1918 | Emerson . | |
| 2,250,022 | 7/1941 | Hoffman . | |
| 2,268,993 | 1/1942 | Sanders . | |
| 2,649,995 | 8/1953 | Muskin . | |
| 2,891,700 | 6/1959 | Maynard . | |
| 3,155,281 | 11/1964 | Stracey . | |
| 3,160,323 | 12/1964 | Weisberg | 222/107 |
| 3,198,392 | 8/1965 | Wilson et al. | 222/107 |
| 3,260,412 | 7/1966 | Larkin | 222/107 |
| 3,338,474 | 8/1967 | Olson . | |
| 3,356,263 | 12/1967 | Monroe | 222/107 |
| 3,508,587 | 4/1970 | Mauch | 222/107 X |
| 3,946,903 | 3/1976 | Parker . | |
| 4,235,653 | 11/1980 | Ausnit . | |
| 5,169,030 | 12/1992 | Lewin . | |
| 5,361,939 | 11/1994 | Robertson, Jr. . | |

*Primary Examiner*—Gregory L Huson
*Attorney, Agent, or Firm*—Richard C. Litman

[57] ABSTRACT

A collapsible dispensing tube providing a flexible walled envelope portion having a dispensing nozzle selectively sealed with a threaded cap and a sealed base. Interlocking fasteners are formed on the inner surface of the flexible wall in opposed registry with each other at regular spaced intervals from the sealed base of the flexible wall to the dispensing nozzle. The interlocking fasteners attach the opposed inner surfaces of the flexible wall when they squeezed together from the base toward the dispensing nozzle to sequentially form transverse closure bands across the envelope portion of the tube. This limits the rearward displacement of the material in the tube that occur when the tube is squeezed in its middle and therefore eliminates the need to roll up the envelope portion of the tube to dispense the material therein. A deformable collar joins the flexible wall of the tube and the dispensing nozzle so that the opposed inner surfaces of the flexible wall adjacent the dispensing nozzle may be squeezed together to allow the last portion of material contained in the tube to be dispensed.

8 Claims, 5 Drawing Sheets

COLLAPSIBLE DISPENSING TUBE WITH INTERLOCKING INTERNAL MEMBERS

BACKGROUND OF THE INVENTION

1. Field of the Invention

The present invention relates to a container for fluid materials. More specifically the present invention is a generally tubular container with flexible walls which may be collapsed sequentially utilizing improved interlocking internal members to dispense the material held therein.

2. Description of Related Art

Dispensing tubes for fluid or semi-solid materials such as toothpaste are well known. The majority of these tubes provide a flexible housing or envelope defining an internal cavity to be filled with the material to be dispensed. These tubes generally have a single open end which is selectively sealable with a cap or other structure. The material in these tubes is dispensed by removing the cab and pressing or squeezing the tube.

While this is generally effective, inefficiencies arise whesn a tube of this type is squeezed at any point other than the base of the tube causing some portion of the material to be displaced rearward toward the base of the tube as well as forward toward the open end of the tube. This becomes a significant problem as the tube becomes less full.

One way of dealing with this problem is to roll the tube up from its base to form a transverse closure band across the breadth of the tube. The transverse closure band limits the rearward displacement of the material held in the tube thereby allowing a portion of the remaining contents to be dispensed effectively. This can be an awkward and inefficient procedure as the tube often becomes unrolled either due to the resilience of the tube wall or due to improperly squeezing the tube an some point other than the base of the tube.

Many dispensing tubes attempting to make it easier to dispense the material contained therein have been disclosed in the relevant art. These have included dispensing tubes adapted to partially prevent rearward displacement of the material contained therein during dispensing, dispensing tubes with flexible walls which collapse in different configurations to force the material held therein out of an opening in the tube, and dispensing tubes which rely on an attachable device to aide in dispensing of the material held therein.

U.S. Pat. No. 5,169,030, issued Dec. 8, 1992 to Jack R. Lewin, discloses a flexible walled dispensing tube which partially prevents the rearward displacement of the material contained therein during dispensing through the use of flexible diaphragm members which divide the tube into several chambers. Each diaphragm member has a one way valve therein which allows the material in the tube to pass through each diaphragm toward the tube opening while preventing the material in one chamber from passing into a rearward chamber.

U.S. Pat. No. 2,891,700, issued Jun. 23, 1959 to Michael Maynard, discloses a dispensing tube having, in one embodiment, projections formed on the inner surface of the flexible walls of the tube. The projections prevent a transverse closure band from being formed inside the tube to avoid trapping a portion of the material contained in the tube rearward of the transverse closure band so that the contents of the tube may be completely dispensed.

U.S. Pat. No. 4,235,653, issued Nov. 25, 1980 to Steben Ausnit, discloses a container formed of a flexible web folded into an open mouth bag. The flexible walls of the bag have releasable interlocking fasteners formed on their inner surfaces which act to hermetically seal the bag.

U.S. Pat. No. 3,946,903, issued Mar. 30, 1976 to Carol Parker, discloses a dispensing tube having flexible walls that are spirally fluted. The walls of the dispensing tube of Parker are adapted to collapse in accordion fashion as the bottom of the tube is twisted to force the material out of the opening in the top of the tube.

U.S. Pat. Nos. 2,268,993, issued Jan. 6, 1939 to Rudolph M. Sanders, 2,250,022, issued Jul. 22, 1941 to Malcom E. Hofman, and 2,649,995, issued Aug. 25, 1953 to Nathan Muskin, disclose dispensing tubes having flexible walls which collapse in accordion fashion when the rearward end of the tube is urged toward the opening in the tube to dispense the material contained therein.

U.S. Pat. No. 5,361,939, issued Nov. 8, 1994 to James A. Robertson, Jr., discloses a dispensing tube which utilizes an attachable retaining device that holds the tube in a rolled position as it is being collapsed. The retaining device must be detached in order to continue to roll the tube and then reattached after each use to hold the tube in the rolled position.

U.S. Pat. Nos. 1,286,875, issued Dec. 3, 1918 to William E. Emmerson and 3,155,281, issued Nov. 3, 1964 to John Stracey, disclose dispensing tubes having flexible walls that are collapsed in accordion fashion as the material held therein is being displaced. The dispensing tubes of Emmerson and Stracey utilize threaded base members which act to collapse the dispensing tubes when the base members are twisted.

However, none of the related art discloses a flexible walled dispensing tube having interlocking fasteners formed on the inner surface of the flexible walls which form transverse closure bands in the tube to help prevent the rearward displacement of the material held therein as the material is being dispensed.

None of the above inventions and patents, taken either singularly or in combination, is seen to describe the instant invention as claimed. Thus a collapsible dispensing tube solving the aforementioned problems is desired.

SUMMARY OF THE INVENTION

The collapsible dispensing tube of the present invention provides a flexible walled envelope portion having a sealed base at one end thereof and a dispensing nozzle, which may be selectively sealed with a threaded cap, at the other end thereof. The opposite faces or halves of the inner surface of the envelop portion have a plurality of alternating ridges and grooves which are arranged transversely across the length of the envelope portion. The grooves of each face registers with the ridge of the opposing face to provide rigidity to the envelope as it becomes flattened during use. Interlocking fasteners are formed on the inner surface of the flexible wall in opposed registry with each other at regular spaced intervals from the sealed base of the flexible wall to the dispensing nozzle. One type of fastener is formed on the ridges of one side of the inner surface and the mating fastener is formed in the grooves of the opposed inner surface, allowing the opposed surfaces to become locked together. Typically the fasteners will secure the opposed surfaces together sequentially from the base toward the dispensing nozzle, forming transverse closure bands across the envelope portion of the tube. This limits the rearward displacement of the material in the tube that would occur when the tube is squeezed at its middle and therefore eliminates the need to roll up the envelope portion of the tube to dispense the material therein. A deformable collar joins the flexible of the envelop portion and the dispensing nozzle so that the opposed inner surfaces of the flexible wall adjacent the dispensing nozzle may be squeezed together to allow the last portion of material contained in the tube to be dispensed.

Accordingly, it is a principal object of the invention to provide a collapsible dispensing tube which need not be rolled in order to dispense the entirety of material held therein.

It is another object of the invention provide a collapsible dispensing tube which dispenses the material held therein in an efficient and orderly fashion.

It is a further object of the invention to provide a collapsible dispensing tube which utilizes interlocking fasteners formed on the inner surface of the tube to attach the top and bottom portions of the tube to limit the rearward displacement of the material held therein.

Still another object of the invention is to provide a collapsible dispensing tube which utilizes a deformable collar to join the flexible wall of the tube and the dispensing nozzle of the tube so that all the material held in the tube may be dispensed.

It is an object of the invention to provide improved elements and arrangements thereof in a collapsible dispensing tube for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
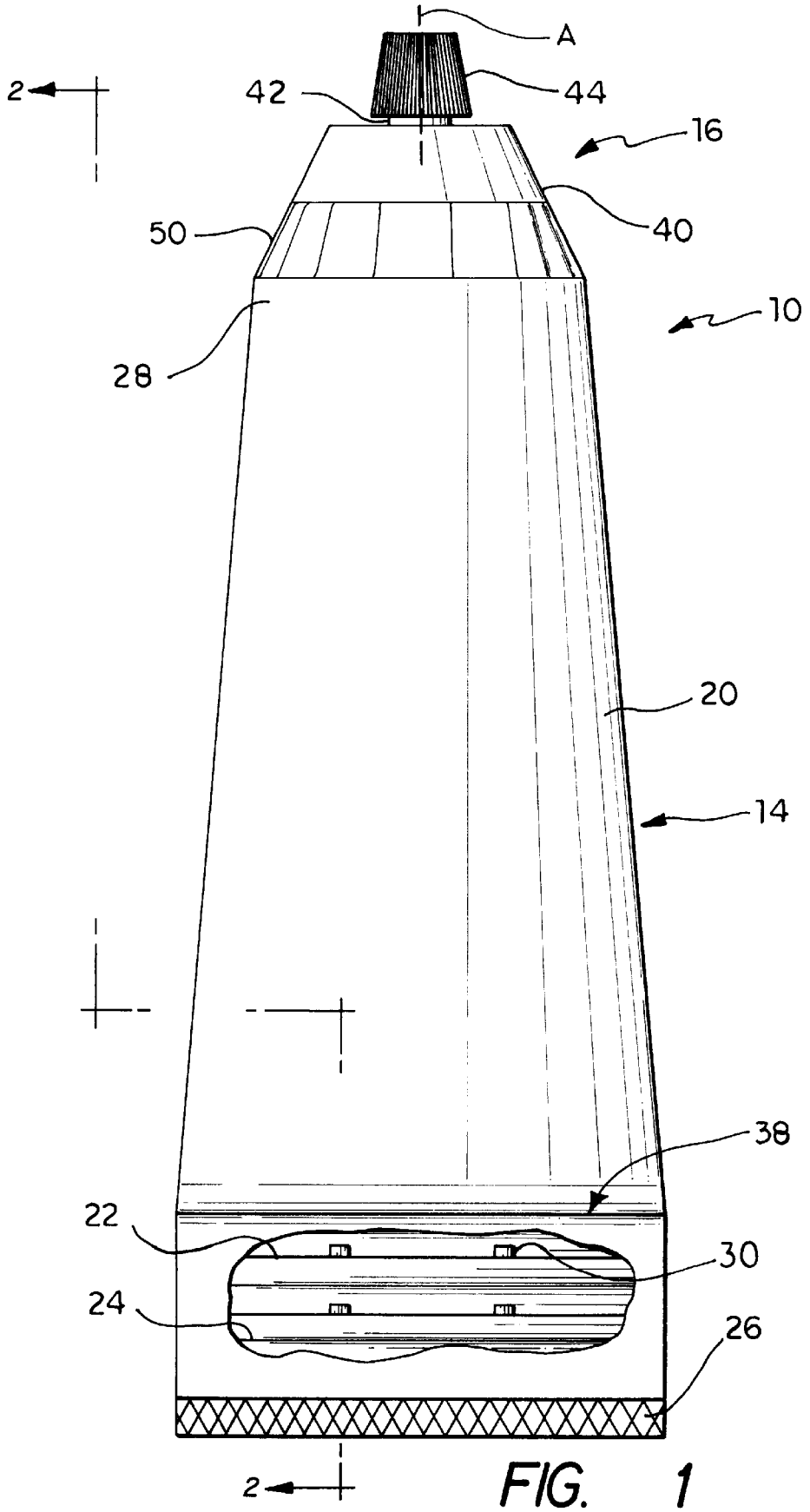
FIG. 1 is a partially cut away plan view of the collapsible tube of the present invention in a partially used state.

Referring to the drawings, FIG. 1 illustrates a collapsible dispensing tube 10 of the present invention adapted to efficiently contain and dispense fluid or semi-solid materials such as toothpaste. The tube 10 generally comprises a material holding envelope portion 14 and a nozzle assembly 16 through which the material is to be dispensed. The envelope portion 14 and the nozzle assembly 16 are joined together by a flexible collar 50, which is more fully described hereinafter.

The envelope portion 14 is formed by a continuous flexible wall 20 formed of a pliable material, such as any variety of thermoplastic materials which are well known in the art. The envelope portion 14 includes a sealed base 26 at one end thereof, an opposite forward end 28 which is open, and a longitudinal axis A extending in the length thereof. The base 26 of the envelope portion is sealed (i.e., heat sealing, crimping, etc.) by joining a first half of the inner surface of the flexible wall 20 with an opposing second half of the inner surface of the flexible wall 20.

Figure 2:
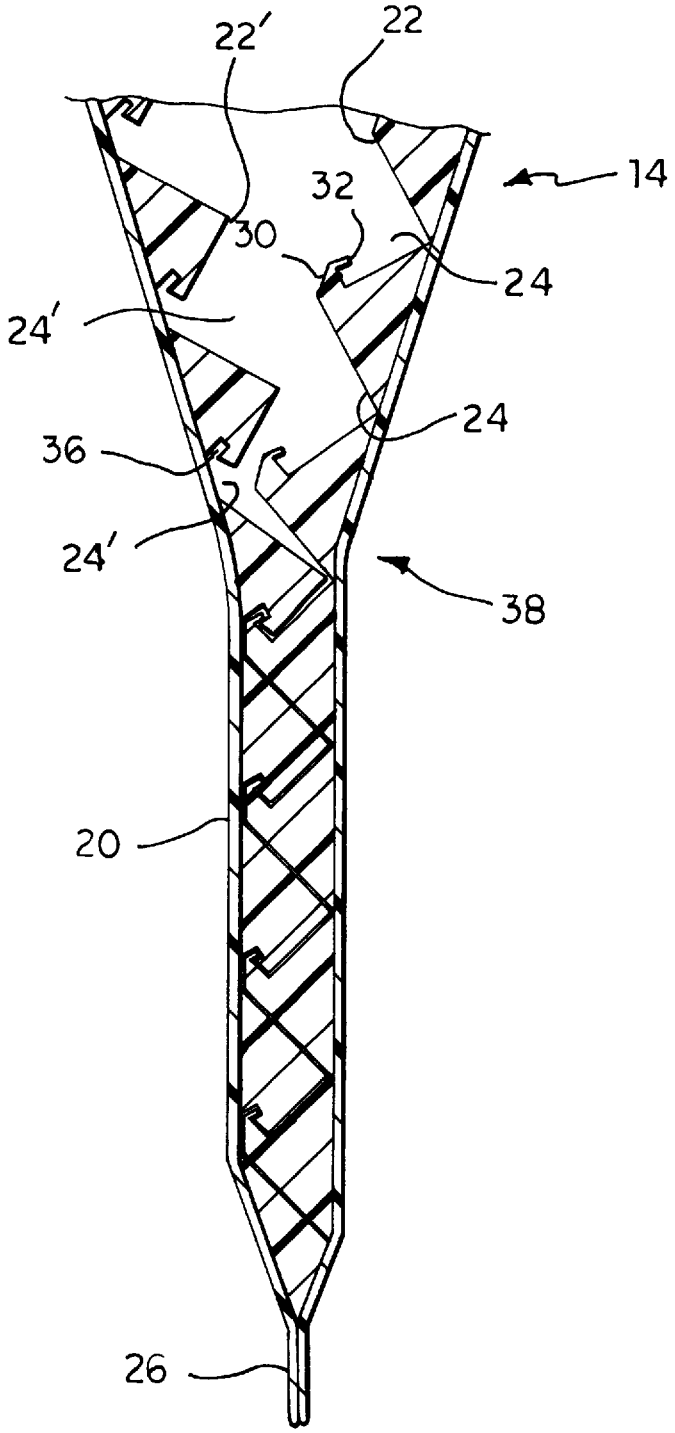
FIG. 2 is an enlarged, cross sectional view of the collapsible tube taken along line 2—2 of FIG. 1.
Figure 5:
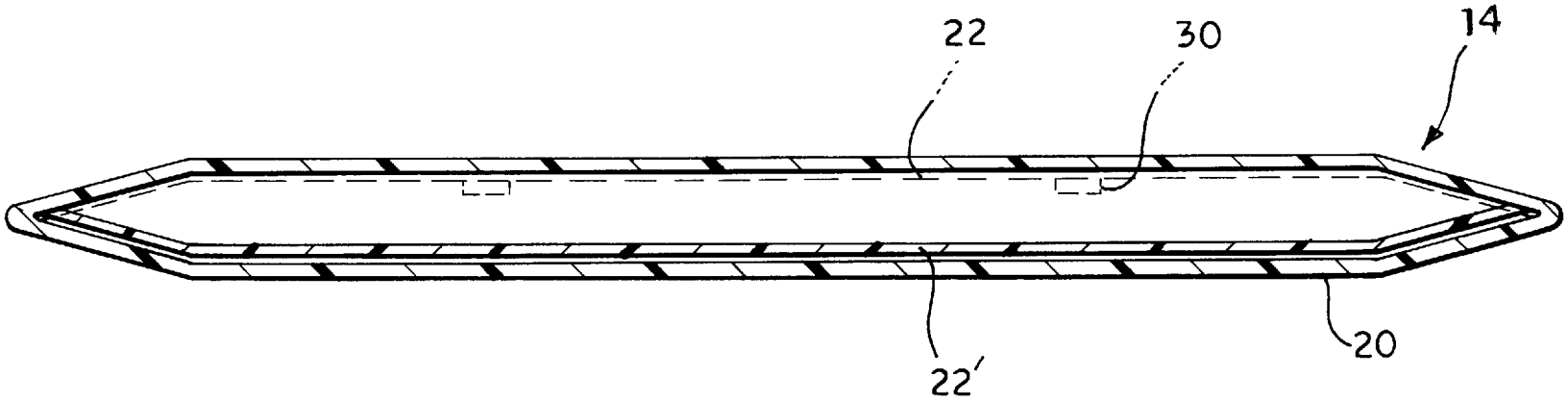
FIG. 5 is a cross sectional view of the collapsible tube taken along line 5—5 of FIG. 4.

The first and second halves of the inner surface of the flexible wall 20 have a plurality of alternating ridges 22,22' and grooves 24,24' formed thereon, respectively, and arranged transversely to the longitudinal axis of the envelope portion 14. The ridges 22 on the first half of the inner surface of the flexible wall 20 confront the grooves 24' on the second half of the inner surface of the flexible wall and the ridges 22' on the second half of the inner surface of the flexible wall 20 confront the grooves 24 in the first half of the inner surface of the flexible wall 20. This allows each ridge 22,22' to interfit with one groove 24,24' when the first and second halves of the flexible wall 20 are squeezed together. This is illustrated in FIG. 2 and FIG. 5.

A plurality of fastener pairs including a male member 30 and a female member or notch 36 are formed on the inner surface of the flexible wall 20 at spaced intervals along the longitudinal axis thereof. In the preferred embodiment of the present invention, two transversely spaced male members 30 are formed on each ridge 22 on the first half of the inner surface of the flexible wall 20 and two transversely spaced female members or notch 36 are recessed into each ridge 22' on the second half of the inner surface of the flexible wall 20 in opposed registry with the male members 30. This can be seen in FIGS. 1 and 2. While not shown, it should be apparent to one skilled in the art that a second plurality of fastener pairs may also be formed on the inner surface of the flexible wall 20 at spaced intervals along the longitudinal axis thereof. For example, two transversely spaced male members may be formed on each ridge 22' on the second half of the inner surface of the flexible wall 20 and two transversely spaced female members may be recessed into each ridge 22' on the first half of the inner surface of the flexible wall 20 in opposed registry with the male members.

Each male member 30 protrudes forward from a ridge 24 and includes a distal end having a flange 32 formed thereon. Each female member 36 is adapted and configured to receive the distal end of a male member 30 so that the flange 32 thereon is fixedly received by a notch 36. In this arrangement, the male member 30 and the female member or notch 36 will fixedly interfit when a transverse section of the first and second halves of the flexible wall 20 are squeezed together to thereby form a transverse closure band 38 on the envelope portion 14.

As the envelope portion 14 is squeezed to urge the material held therein toward the open forward end thereof, the material held in the envelope portion of the tube will be dispensed through the nozzle assembly 16. The nozzle assembly 16 includes a shoulder 40, a nozzle 42, and cap 44.

The shoulder 40 is a frustoconical shell having a front surface and a rearward margin, with a hole formed through the radial center of the front surface. The nozzle 42 is integral with the front surface of the shoulder 40 around the hole formed therethrough so that it extends forward from the front surface of the shoulder 42. The nozzle 40 is preferably a hollow cylinder which is open at both ends to define a passageway through which the fluid and semi-solid material may be dispensed. The nozzle 42 is externally threaded to receive the internally threaded cap 44 which is sized to be removably secured on the nozzle 42 to seal the passageway defined by the nozzle 42. This can be seen in FIGS. 1, 3, and 5.

The shoulder 40 is connected to the open forward end 28 of the envelope portion 14 by the collar member 50, which is made from a flexible and stretchable material. The collar member 50 is sealed to the rearward margin of the shoulder 40 around the entire circumference thereof. The opposite end of the collar member 50 is sealed to the forward end 28 of the envelope portion 14 around the entire circumference thereof so that the collar member 50 interconnects the envelope portion 14 with the nozzle assembly 16 of the tube.

Figure 3:
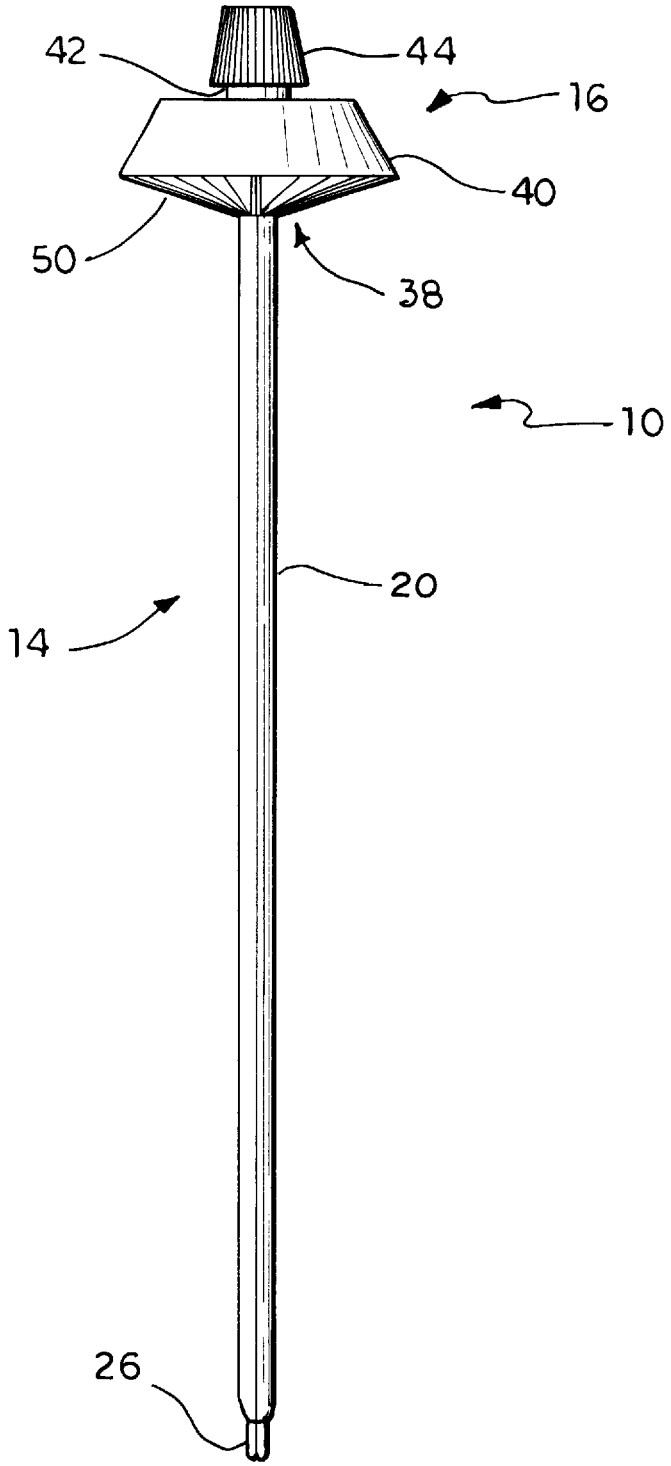
FIG. 3 is a side view of the collapsible tube of the present invention in a fully used state.
Figure 4:
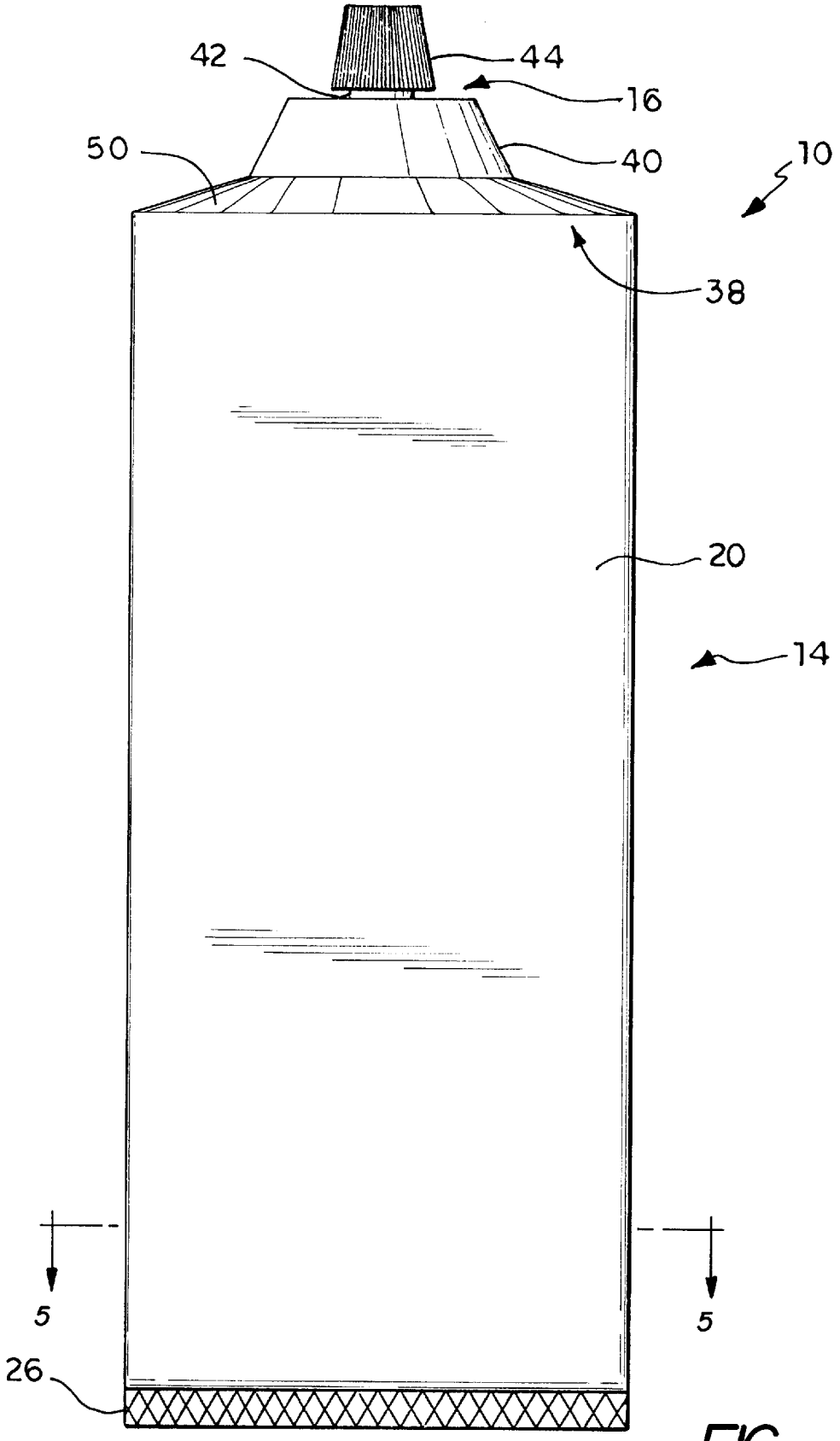
FIG. 4 is a top view of the collapsible tube of the present invention in a fully used state.

Referring now to FIGS. 3 and 4, it can be seen that the first and second halves of the flexible wall 20 adjacent the forward end thereof will be drawn toward each other as the tube becomes empty. As this happens the cross section of the envelope portion of the tube 10 will change from a generally circular shape to the flattened, narrow shape illustrated in FIG. 5. The collar member 50 is adapted to deform as the first and second halves of the flexible wall 10 are squeezed together. This maintain a sealed connection between the nozzle assembly 16 and the envelope portion 14.

In use, a user will remove the cap 44 from the nozzle 42 and squeeze the envelope portion 14 of the tube to dispense material therein from the nozzle. With continued dispensing the volume of material will decrease inside the envelope portion 14. As this occurs, the users will apply pressure against the opposite sides of the envelope portion 14 slightly above the sealed base 26. With application of external pressure, the confronting ridges 22,22' and grooves 24,24' will register and become locked together as the male fasteners 30 and female fasteners 36 thereon engage. This creates the transverse closure band 38, which prevents material therein from flowing toward the base 26. With additional use, the user will apply external pressure above the transverse closure band 38 until to create a new transverse closure band located closer to the nozzle assembly 16. Eventually, the entire envelope portion 14 will flatten and the collar member 50 will expand as the user squeezes the last material from the tube 10.

It is to be understood that the collapsible dispensing tube of the present invention is not limited to the embodiment described above, but encompasses any and all embodiments within the scope of the following claims.

I claim:

1. A collapsible dispensing tube for dispensing quantities of fluid and semi-solid materials, comprising:

an envelope portion having a continuous flexible wall with an open end and a sealed base opposite said open end, said wall defining a first half inner surface and a second half inner surface, said envelope portion also having a longitudinal axis extending in the direction from said open end to said sealed base;

a nozzle assembly connected to said envelope portion at said open end thereof; and a plurality of first alternating ridges and grooves formed on said first half inner surface and a plurality of second alternating ridges and grooves formed on said second inner surface of said flexible wall, said plurality of first and second alternating ridges and grooves being arranged at spaced intervals along said longitudinal axis of said envelope portion, each of said first alternating ridges includes a plurality of traversely spaced male members, and each of said second alternating ridges includes a corresponding number of traversely spaced female members connectable to said male members to thereby form a transverse closure band across said envelope portion.

2. The collapsible dispensing tube as defined in claim 1 wherein each of said male members is flexible and extends angularly upwards in a direction towards the open end of said envelope portion, and each of said female members is rigid and extends angularly downward in a direction towards the base of said envelope portion.

3. The collapsible dispensing tube as defined in claim 2 wherein each of said male members has a flange formed on a distal end thereof and each of said female members includes a notch adapted to fixedly receive said flange of the male member.

4. The collapsible dispensing tube as defined in claim 1 wherein said nozzle assembly comprises:

a shoulder portion connected to said flexible wall at said open end thereof;

a nozzle integral with said shoulder portion and extending outwardly therefrom, said-nozzle having a passageway communicating with said material holding cavity; and a cap adapted and configured to be removably secured on said nozzle to seal said passageway.

5. The collapsible dispensing tube as defined in claim 4 further including a collar member sealed to said shoulder portion of said nozzle assembly and sealed to said flexible wall of said envelope portion, said collar member being generally ring shaped and formed of a flexible and stretchable material.

6. A collapsible dispensing tube for dispensing quantities of fluid and semi-solid materials, comprising:

an envelope portion having a continuous flexible wall with an open end and a sealed base opposite said open end, said wall defining a first half inner surface and a second half inner surface, said envelope portion also having a longitudinal axis extending in the direction from said open end to said sealed base;

a collar member sealed to said flexible wall at said open end of said envelope portion, said collar member being generally ring shaped and formed of a flexible and stretchable material;

a nozzle assembly sealed to said collar member opposite said envelope portion, said nozzle assembly having a passageway in communication with said material holding cavity;

a plurality of first alternating ridges and grooves formed on said first half inner surface and a plurality of second alternating ridges and grooves formed on said second inner surface of said flexible wall said plurality of first and second alternating ridges and grooves being arranged at spaced intervals along said longitudinal axis of said envelope portion, each of said first alternating ridges includes a plurality of traversely spaced male members, and each of said second alternating ridges includes a corresponding number of traversely spaced female members connectable to said male members to thereby form a transverse closure band across said envelope portion.

7. The collapsible dispensing tube as defined in claim 6 wherein each of said male members is flexible and extends angularly upwards in a direction towards the open end of said envelope portion, and each of said female members is rigid and extends angularly downward in a direction towards the base of said envelope portion.

8. The collapsible dispensing tube as defined in claim 7 wherein each of said male members has a flange formed on a distal end thereof and each of said female members includes a notch adapted to fixedly receive said flange of the male member.

* * * * *